US005400575A

United States Patent [19]

Scherer

[11] Patent Number: 5,400,575

[45] Date of Patent: Mar. 28, 1995

[54] WRAPPING FILM-CUTTING APPARATUS

[75] Inventor: Philip G. Scherer, Fort Lauderdale, Fla.

[73] Assignee: Mima Incorporated, Glenview, Ill.

[21] Appl. No.: 108,467

[22] Filed: Aug. 18, 1993

[51] Int. Cl.[6] ..... B65B 41/00; B65B 13/04

[52] U.S. Cl. ..... 53/556; 53/587; 53/389.3

[58] Field of Search ..... 53/556, 587, 588, 389.3, 53/217, 211, 209; 83/176, 602, 607, 611

[56] References Cited

U.S. PATENT DOCUMENTS

| | | | |
|---|---|---|---|
| 1,562,045 | 11/1925 | Pels | 83/602 |
| 1,710,950 | 4/1929 | Robertson | 83/602 |
| 1,955,811 | 4/1934 | Irmscher | 83/602 |
| 4,249,308 | 2/1981 | Boyajian | 83/602 |
| 4,255,918 | 3/1981 | Lancaster | 53/556 |
| 4,429,441 | 3/1984 | Nishiyama | 83/602 |
| 4,432,185 | 2/1984 | Geisinger | 53/138 R |
| 4,563,863 | 1/1986 | Humphrey | 53/556 |
| 4,619,102 | 10/1986 | Geisinger | 53/399 |
| 4,932,296 | 6/1990 | Boone | 83/607 |
| 4,972,656 | 11/1990 | Haugstad | 53/211 |

*Primary Examiner*—Lowell A. Larson
*Assistant Examiner*—Rodney A. Butler
*Attorney, Agent, or Firm*—Schwartz & Weinrieb

[57] ABSTRACT

An apparatus for cutting stretch film or other wrapping film comprises a fixed blade and having a sharpened edge, and a pivotable anvil having a blunt edge, and a camming edge which has a concave portion and a further portion. The anvil is pivotable between an opened position relative to the blade and a closed position relative thereto. A camming roller engages the camming edge. A pneumatically powered piston-cylinder mechanism is operative for advancing the camming roller from a retracted position, through an intermediate position, to an advanced position and for retracting the camming roller in the opposite direction so as to pivot the anvil to the opened position when the camming roller is retracted to the retracted position, so as to pivot the anvil to the closed position when the camming roller is advanced to the intermediate position, and so as to press the anvil in the closed position when the camming roller is advanced from the intermediate position to the advanced position. An elongate bar having a flanged end is movably mounted upon to the frame so as to be longitudinally movable between an extended position wherein the elongate bar is capable of being wrapped by such film and a withdrawn position near the blade and anvil. A pneumatically powered piston-cylinder mechanism is operative to move the elongate bar longitudinally between the extended and withdrawn positions.

16 Claims, 2 Drawing Sheets

WRAPPING FILM-CUTTING APPARATUS

TECHNICAL FIELD OF THE INVENTION

This invention pertains to an apparatus for cutting stretch film or other wrapping film. The apparatus employs a fixed cutter having a cutting edge, a pivotable cutter having a cutting edge, and a mechanism for pivoting the pivotable cutter between an opened position relative to the fixed cutter and a closed position relative thereto. Another mechanism may also be employed for gathering the film into a rope-like configuration between the cutting edges when the second cutter is in the opened position. The apparatus is useful in a wrapping machine.

BACKGROUND OF THE INVENTION

A machine of a type in widespread use for wrapping packages with plastic film supplied on a roll, such as stretch film, comprises a frame, a ring rotatable on the frame and defining a circular path around a horizontal axis, a support extending horizontally toward an open center of the ring and arranged to support a package being wrapped, and a carriage mounted to the ring for conjoint movement with the ring and arranged to support the roll of film with its axis parallel to the horizontal axis of the ring. The support may be a ledge or a conveyor. The carriage is movable along the circular path, around the ledge, when the ring is rotated so that film from the roll supported by the carriage is wrapped in successive layers, around the support and around a package supported by the support, as the carriage is moved around the ring.

A wrapping machine of the type noted above is available commercially from ITW Mima (an Illinois Tool Works Company) of Boca Raton, Fla., under the trade designations "ITW Mima MSB" and "Mima Stretch Bundler". Heretofore, this machine has employed a manually actuated cutting and clamping mechanism, which catches and cuts the last wrap of stretch film.

OBJECTS OF THE INVENTION

This invention provides an improved apparatus, which may be pneumatically powered, for cutting stretch film or other wrapping film. The improved apparatus is useful in a wrapping machine, such as the machine discussed in the preceding paragraph.

SUMMARY OF THE INVENTION

According to a first aspect of this invention, the improved apparatus comprises a frame, a first cutter fixedly mounted upon the frame and having a cutting edge, and a second cutter having a proximal end and a distal end, pivotally mounted upon the frame, near the proximal end, and having two opposite edges, namely a cutting edge and a camming edge. The camming edge has a concave portion near the proximal end and a further portion. The concave portion has a proximal edge near the proximal end and a distal edge merging with the further portion.

The second cutter is pivotable between an opened position and a closed position. In the opened position, the cutting edge of the second cutter is opened away from the cutting edge of the first cutter. In the closed position, the cutting edge of the second cutter is closed against the cutting edge of the first member. A camming member, such as a roller, engages the camming edge of the second cutter. Preferably, the first cutter is a blade, the cutting edge of which is sharp, and the second cutter is an anvil, the cutting edge of which is blunt.

Preferably, the improved apparatus further comprises means for advancing the camming member from a retracted position, through an intermediate position, to an advanced position and for retracting the camming member from the advanced position, through the intermediate position, to the retracted position such that the camming member engages the proximal edge of the concave portion of the camming edge so as to pivot the second cutter to the opened position when the camming member is retracted from the intermediate position to the retracted position, such that the camming member engages the distal edge of the concave portion of the camming edge so as to pivot the second cutter to the closed position when the camming member is advanced from the retracted position to the intermediate position, and such that the camming member engages the further portion of the camming edge so as to press the second cutter against the first cutter when the camming member is advanced from the intermediate position toward the advanced position. The advancing and retracting means may comprise a piston-cylinder mechanism connected operatively connected to the frame and to the camming member and operative to advance the camming member and to retract the camming member.

According to a second aspect of this invention, the improved apparatus comprises a frame, a first cutter fixedly mounted upon the frame and having a cutting edge, a second cutter pivotally mounted upon the frame and having a cutting edge, the second cutter being pivotable between an opened position wherein the cutting edge of the second cutter is opened away from the cutting edge of the second cutter and a closed position wherein the cutting edge of the second cutter is closed against the cutting edge of the first cutter, means for pivoting the second cutter between the opened and closed positions, and means for gathering the film into a rope-like bunch between the cutting edges of the first and second cutters when the second cutter is in the opened position.

Preferably, the gathering means comprises an elongate bar having a flanged end, the elongate bar being movably mounted upon the frame so as to be longitudinally movable between an extended position wherein the flanged end is relatively far from the first and second cutters and wherein the elongate bar is capable of being wrapped by such film, and a withdrawn position wherein the flange is relatively close to the first and second cutters. Preferably, the gathering means further comprises a piston-cylinder mechanism operatively mounted upon the frame and to the elongate bar and operative to move the elongate bar longitudinally between the extended and withdrawn positions.

BRIEF DESCRIPTION OF THE DRAWINGS

These and other objects, features, and advantages of this invention will be evident from the following description of a preferred embodiment of this invention with reference to the accompanying drawings , in which like reference characters designate like or corresponding parts throughout the several views, and wherein.

DETAILED DESCRIPTION OF PREFERRED EMBODIMENT

Figure 1:
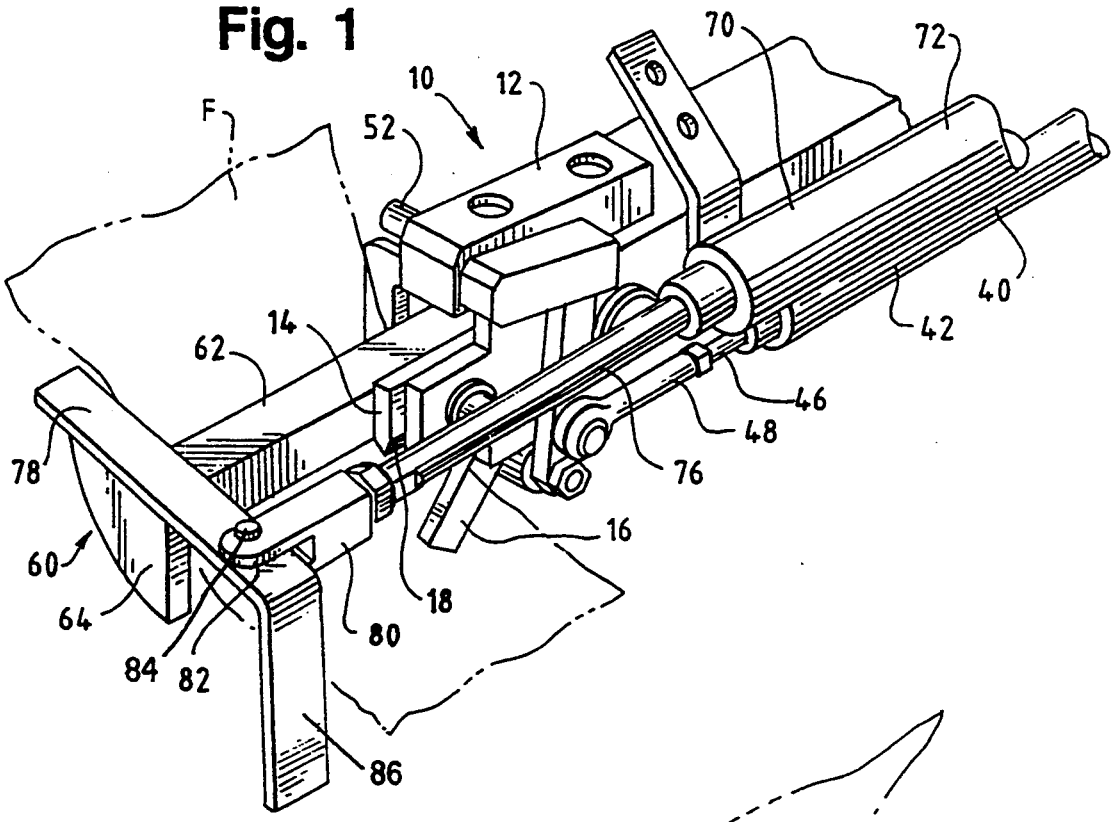
FIG. 1 is a fragmentary, perspective view of a cutting apparatus embodying this invention, as seen from an upper vantage.
Figure 2:
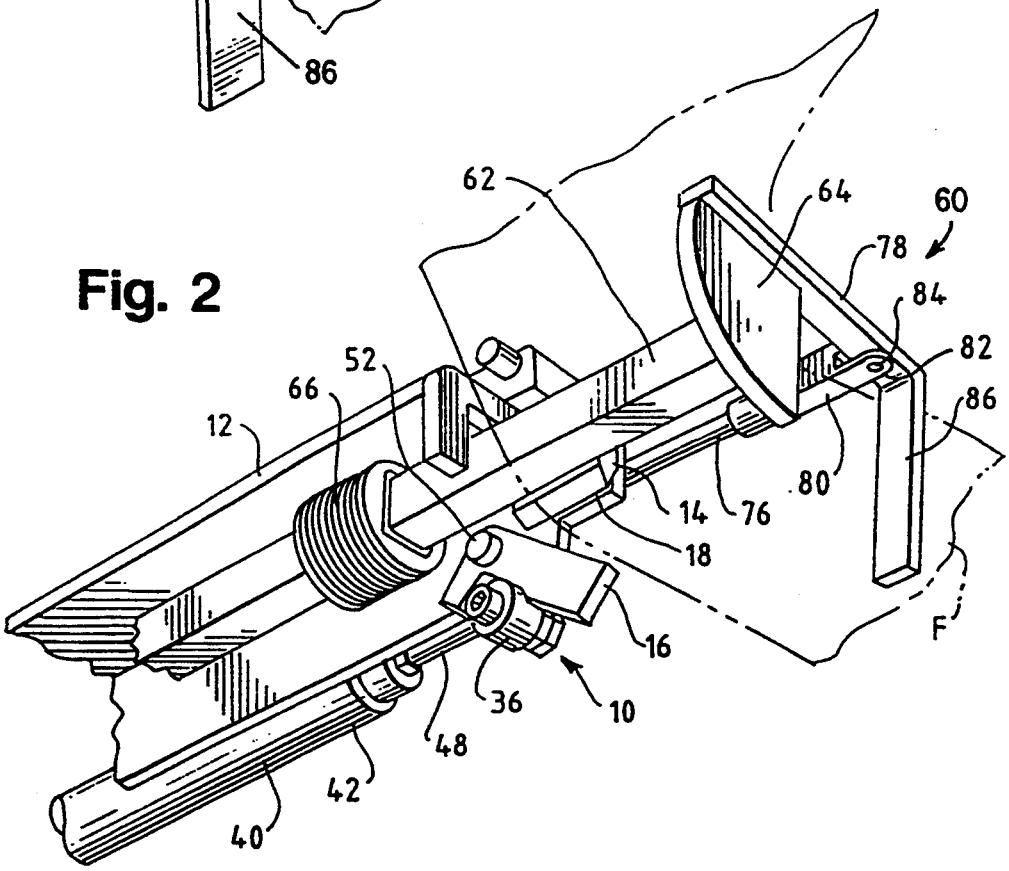
FIG. 2 is a fragmentary, perspective view of the cutting apparatus of FIG. 1, as seen from a lower vantage.
Figure 3:
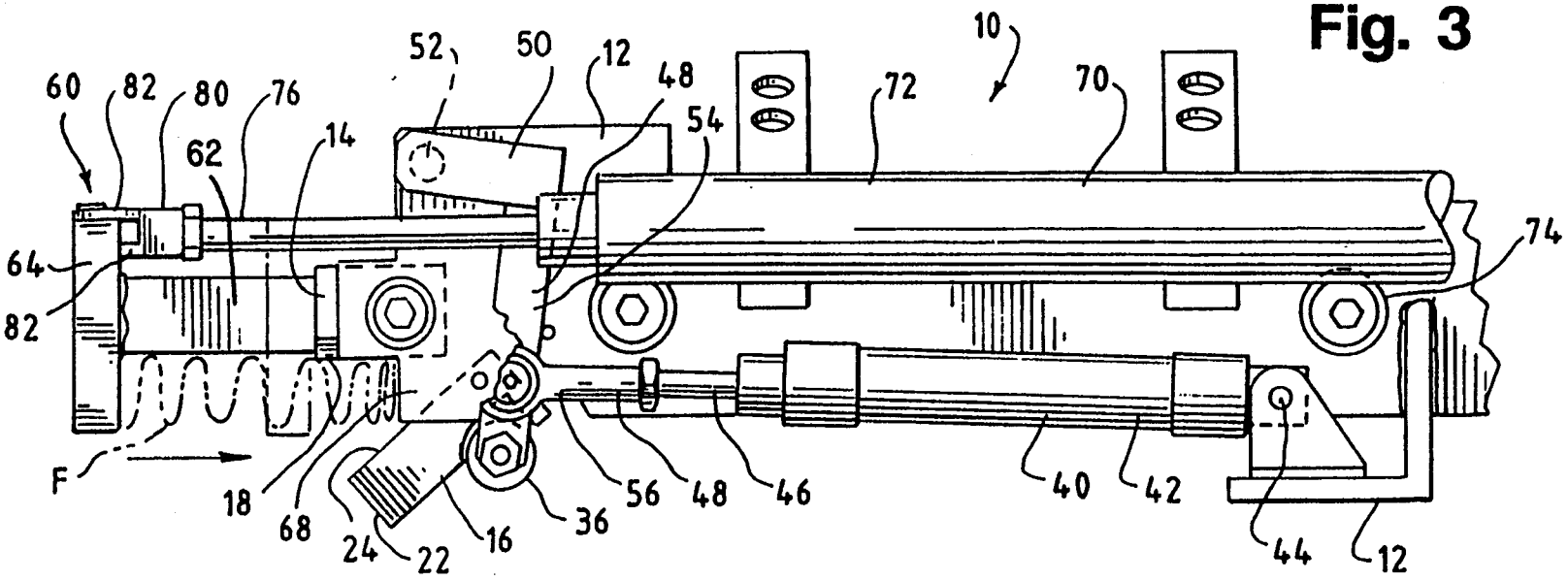
FIG. 3, on a larger scale, is an elevational view of the cutting apparatus, as shown in FIG. 1, with some elements being shown at changed positions in full and dashed lines.

As shown in the FIGS. 1, 2, and 3, an apparatus 10 constitutes a preferred embodiment of this invention. The apparatus 10 is useful in a wrapping machine (not shown) of the type noted above, which is used to wrap stretch film F or other wrapping film around a load (not shown) from a roll (not shown) moved in a circular path about a horizontal axis. The apparatus 10 is used to gather the film F into a rope-like configuration and to cut the gathered film F so as to cut the film F wrapped around the load from the film F remaining on the roll.

The apparatus 10 comprises a frame 12 fixedly mounted upon a fixed portion of the wrapping machine, a blade 14 fixedly mounted upon the frame 12, and an anvil 16 pivotally mounted upon the frame 12. The blade 14 has a straight, sharp cutting edge 18. The anvil 16 has a proximal end 20, near which the anvil 16 is pivotally mounted upon the frame 12, and a distal end 22. The anvil 16 has a blunt cutting edge 24 and an opposite camming edge 26, which has a concave portion 28 near the proximal end 20 and a further, straight portion 30 extending to the distal end 22. The concave portion 28 of the camming edge 26 has a proximal edge 32 near the proximal end 20 and a distal edge 34, which merges with the straight portion 30 of the camming edge 26 so as to define an obtuse angle, as shown. The apparatus 10 comprises a camming roller 36 engaging the camming edge 26 so as to roll on the camming edge 26.

The apparatus 10 comprises a double-acting, pneumatically powered, piston-cylinder mechanism 40 operatively connected to the frame 12 and selectively operative to advance the camming roller 36 from a retracted position, through an intermediate position, to an advanced position and to retract the camming roller 36 from the advanced position, through the intermediate position, to the retracted position. The mechanism 40 includes a cylinder 42 operatively connected to the frame 12 at a pivotal connection 44, a piston (not shown) reciprocatingly moveable within the cylinder 42, and a piston rod 46 operatively connected to the piston and to the camming roller 36. The piston rod 46 is operatively connected to the camming roller 36 by the means of a generally L-shaped link 48, which has a relatively short arm 50 pivotally mounted upon the frame 12 by means of a pivot pin 52 and a relatively long arm 54 rotatably mounting the camming roller 36. The piston rod 46 is pivotally connected to the arm 54, between the camming roller 36 and the arm 50, by means of a pivot link 56 extending rigidly and axially from the piston rod 46.

Figure 6:
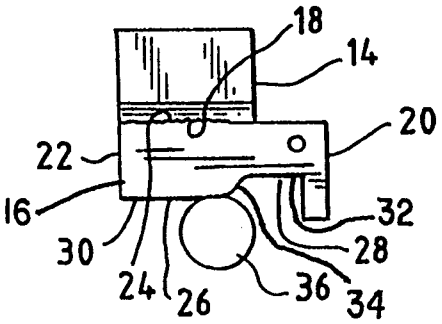
FIGS. 5 and 6 are simplified, elevational views of the fixed blade, the pivotable anvil, and an associated roller, in successive, changed positions.
Figure 5:
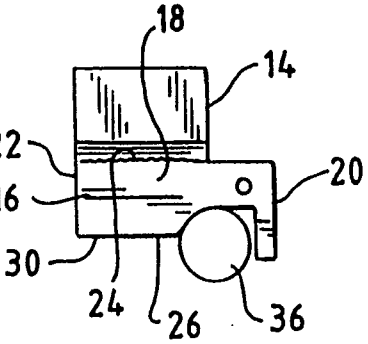
Figure 4:
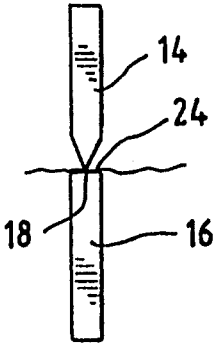
FIG. 4 is an end view of a fixed blade and a pivotable anvil, as included in the cutting apparatus of FIGS. 1, 2, and 3, with the anvil in a closed position.

The piston-cylinder mechanism 40 is selectively operative to advance the camming roller 36 from a retracted position, through an intermediate position, to an advanced position and to retract the camming roller from the advanced position, through the intermediate position, to the retracted position. In FIGS. 1, 2, and 3, the camming roller 36 is shown in the retracted position. In FIG. 5, the camming roller 36 is shown in the intermediate position. In FIG. 6, the camming roller 36 is shown in the advanced position.

As the piston rod 46 is extended from the cylinder 42, the pivot link 56 is moved axially with the piston rod 46 so as to advance the camming roller 36. As the camming roller 36 is advanced from the retracted position to the intermediate position, in which the camming roller 36 is shown in FIG. 5, the camming roller 36 engages the distal edge 34 of the concave portion 28 of the camming edge 26 of the anvil 16 so as to pivot the anvil 16 from the opened position to the closed position. As the camming roller 36 is advanced from the intermediate position to the advanced position, in which the camming roller 36 is shown in FIG. 6, the camming roller 36 engages the straight portion 30 of the camming edge 26 of the anvil 16 so as to press the anvil 16 against the blade 14.

A mechanism 60 to be next described is provided for gathering the film F into a rope-like configuration between the sharp cutting edge 18 of the blade 14 and the blunt cutting edge 24 of the anvil 16 when the anvil 16 is in the opened position. When the film F has been gathered into a rope-like configuration therebetween, the blade 14 cuts the gathered film F in the rope-like configuration, as the anvil 16 is pivoted to the closed position and as the anvil 16 is pressed against the blade 14.

The gathering mechanism 60 comprises an elongate, rectangular bar 62, which has a flanged end 64. The bar 62 is movably mounted upon the frame 12 by means of spaced bearing blocks 66 (one shown) so as to be longitudinally movable between an extended position and a withdrawn position. In the extended position, in which the bar 62 is shown in FIGS. 1 and 2, the flanged end 64 is pushed away from the blade 14 and the anvil 16. In the extended position, moreover, the bar 62 is positioned where the bar 62 is capable of being partially wrapped by a last turn of the film F. In the retracted position, in which the bar 62 is shown in FIG. 3, the flanged end 64 is drawn toward the blade 14 and the anvil 16 so as to gather the last turn of the film F (which turn partially wraps the bar 62) into a rope-like configuration between the sharp cutting edge 18 of the blade 14 and the blunt cutting edge 24 of the anvil 16 when the anvil 16 is in the opened position. As gathered into a rope-like configuration therebetween, the film F is confined between the flanged end 64 and an adjacent portion 68 of the frame 12.

The gathering mechanism 60 also comprises a pneumatically powered piston-cylinder mechanism 70 operatively connected to the frame 12 and to the bar 62 and operative to move the bar 62 longitudinally between the extended and withdrawn positions. The mechanism 70 comprises a cylinder 72 operatively connected to the frame 12 at a pivotal connection 74, a piston (not shown) reciprocatingly movable within the cylinder 72, and a piston rod 76 operatively connected to the piston and to the bar 62. The piston rod 76 is operatively connected to the bar 62 by means of a member 78 fixedly mounted upon the flanged end 64 of the bar 62 and a bifurcated link 80 extending rigidly and axially from the piston rod 76 and linked to the member 78. The link 80 is bifurcated so as to define two arms 82, which embrace the member 78, and is linked to the member 78 by means of a pivot pin 84 passing through aligned holes in the arms 84 and in the member 78. The member 78 has a flange 86, which is oriented so as to help the flanged end 64 of the bar 62 to gather the film F.

When the wrapping machine employing the apparatus 10 is used to wrap a package (not shown) in a known manner, the bar 62 remains in the withdrawn position so as not to interfere with the film F wrapping the package. After the package has been wrapped, the bar 62 is moved to the extended position so as to be partially wrapped with a last turn of the film F, whereupon the bar 62 is moved to the retracted position. Thus, the flanged end 64 of the bar 62 gathers the film F at such turn into a rope-like configuration between the sharp cutting edge 18 of the blade 14 and the blunt cutting edge 24 of the anvil 16, whereby the gathered film F is confined between the flanged end 64 of the bar 62 and the adjacent portion 68 of the frame 12. Next, the blade 14 cuts the gathered film F in the rope-like configuration, as the anvil 16 is pivoted to the closed position and as the anvil 16 is pressed against the blade 14.

Various modifications may be made in the preferred embodiment described above without departing from the scope and spirit of this invention.

I claim:

1. An apparatus for cutting stretch film or other wrapping film, comprising:

a frame;

a first cutter fixedly mounted upon said frame and having a cutting edge;

a second cutter, having a proximal end and a distal end, pivotally mounted upon said frame near said proximal end and having two opposite edges, namely a cutting edge and a camming edge, said camming edge having a concave portion near said proximal end and a further portion, said concave portion having a proximal edge near said proximal end and a distal edge merging with said further portion, said second cutter being pivotable between an opened position wherein said cutting edge of said second cutter is disposed away from said cutting edge of said first cutter and a closed position wherein said cutting edge of said second cutter is disposed against said cutting edge of said first cutter;

a camming member engaging said camming edge of said second cutter; and means for advancing said camming member from a retracted position, through an intermediate position, to an advanced position and for retracting said camming member from said advanced position, through said intermediate position to said retracted position such that said camming member engages said proximal edge of said concave portion of said camming edge so as to pivot said second cutter to said opened position when said camming member is retracted from said intermediate position to said retracted position, such that said camming member engages said proximal edge of said concave portion of said camming edge so as to pivot said second cutter to said opened position when said camming member is retracted from said intermediate position to said retracted position, such that said camming member engages said distal edge of said concave portion of said camming edge so as to pivot said second cutter to said closed position when said camming member is advanced from said retracted position position to said intermediate position, and such that said camming member engages said further portion of said camming edge so as to press said second cutter at said closed position when said camming member is advanced from said intermediate position to said advanced position.

2. The cutting apparatus of claim 1 wherein the camming member is a roller.

3. The cutting apparatus of claim 1 wherein the advancing and retracting means comprises a piston-cylinder mechanism operatively connected to the frame and to the camming member and selectively operative to advance the camming member and to retract the camming member.

4. The cutting apparatus of claim 3 wherein the camming member is a roller.

5. The cutting apparatus of claim 1 wherein the first cutter is a blade, the cutting edge of which is sharp.

6. The cutting apparatus of claim 5 wherein the second cutting member is an anvil, the cutting edge of which is blunt.

7. The cutting apparatus of claim 1 further comprising means for gathering the film into a rope-like configuration between the cutting edges of the first and second cutters when the second cutter is in the opened position.

8. The cutting apparatus of claim 7, wherein:

said gathering means comprises an elongate bar extending across said film and having a flanged end for engaging one edge of said film, said elongate bar being movably mounted upon said frame so as to be longitudinally movable between an extended position wherein said flanged end is disposed away from said first and second cutters and a retracted position wherein said flanged end is drawn toward said first and second cutters so as to gather said film into position between said first and second cutters.

9. The cutting apparatus of claim 8 wherein the gathering means further comprises a piston-cylinder mechanism operatively connected to the frame and to the elongate bar and operative to move the elongate bar longitudinally between the extended and retracted positions.

10. An apparatus for cutting stretch film or other wrapping film, comprising:

a frame;

a first cutter fixedly mounted upon said frame and having a cutting edge;

a second cutter pivotally mounted upon said frame and having a cutting edge, said second cutter being pivotable between an opened position wherein said cutting edge of said second cutter is disposed away from said cutting edge of said first cutter, and a closed position wherein said cutting edge of said second cutter is disposed against said cutting edge of said first cutter;

means for pivoting said second cutter between said opened and closed positions in a generally first direction; and means mounted upon said frame so as to be movable in a second direction which is substantially transverse to said first direction for gathering said film between said movable means and said frame such that said gathered film is interposed between said cutting edges of said first and second cutters when said second cutter is disposed in said opened position, and wherein further, when said second cutter is moved by said pivoting means to said closed position, said gathered film is cut by cooperation between said cutting edges of said first and second cutters.

11. The cutting apparatus of claim 10, wherein:

said gathering means comprises an elongate bar extending across said film and having a flanged end for engaging one edge of said film, said elongate bar being movably mounted upon said frame so as to be longitudinally movable between an extended position wherein said flanged end is disposed relatively remote from said first and second cutters and a retracted position wherein said flanged end is disposed relatively close to said first and second cutters so as to gather said film into position between said first and second cutters.

12. The cutting apparatus of claim 11 wherein the gathering means further comprises a piston-cylinder mechanism operatively connected to the frame and to the elongate bar and operative to move the elongate bar longitudinally between the extended and reacted positions.

13. Apparatus as set forth in claim 10, said pivoting means comprising:

camming means engaging said second cutter and movable between retracted, intermediate, and extended positions for respectively moving said second cutter between said opened position, said closed position, and a closed-pressed position with respect to said first cutter.

14. Apparatus as set forth in claim 13, wherein:

said camming means comprises a camming roller rotatably engaged with said second cutter.

15. Apparatus as set forth in claim 14, further comprising:

piston-cylinder means operatively connected to said camming roller for moving said camming roller between said retracted, intermediate, and extended positions.

16. Apparatus as set forth in claim 10, wherein:

said first cutter comprises a cutting blade; and said second cutter comprises a cutting anvil.

* * * * *